US009887024B1

(12) United States Patent
Broderick et al.

(10) Patent No.: US 9,887,024 B1
(45) Date of Patent: Feb. 6, 2018

(54) CABLE AND CONNECTOR PLACEMENT FIXTURE AND METHOD FOR FABRICATING CABLE ASSEMBLIES

(71) Applicant: Lockheed Martin Corporation, Bethesda, MD (US)

(72) Inventors: Timothy T. Broderick, Voorhees, NJ (US); Felix Polich, Moorestown, NJ (US); David B. Arnal, Mount Laurel, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 228 days.

(21) Appl. No.: 13/748,858

(22) Filed: Jan. 24, 2013

(51) Int. Cl.
*H01B 13/012* (2006.01)
*H01R 43/00* (2006.01)

(52) U.S. Cl.
CPC ..... *H01B 13/012* (2013.01); *H01R 43/00* (2013.01); *Y10T 29/53213* (2015.01); *Y10T 29/53265* (2015.01)

(58) Field of Classification Search
CPC ..... H01R 13/60; Y10T 29/49194; Y10T 29/53213; Y10T 29/53265; A47F 5/02; A47F 5/025; A47F 5/0087; A47F 5/0093; H01B 13/012
USPC ..... 211/163, 166, 167, 169, 174, 205; 160/229.1, 223, 234; 248/284.1
See application file for complete search history.

(56) References Cited

U.S. PATENT DOCUMENTS

| | | | | |
|---|---|---|---|---|
| 2,936,902 | A * | 5/1960 | Sinclair | A47F 5/0876 211/119.013 |
| 3,917,072 | A * | 11/1975 | Bleed | A47F 5/02 211/167 |
| 4,461,443 | A * | 7/1984 | Dauman | A47F 5/0846 211/87.01 |
| 4,723,663 | A * | 2/1988 | Learn | 211/59.2 |
| 6,364,141 | B1 * | 4/2002 | Ehrgott | 211/189 |
| 7,604,027 | B2 * | 10/2009 | Thatcher | 144/286.5 |
| 2005/0188899 | A1 * | 9/2005 | Yovich | A47B 23/002 108/10 |
| 2006/0266432 | A1 * | 11/2006 | Carter | B25H 1/02 144/286.1 |

FOREIGN PATENT DOCUMENTS

EP 0206988 A1 * 12/1986 ..... A47F 5/02

* cited by examiner

*Primary Examiner* — Livius R Cazan
(74) *Attorney, Agent, or Firm* — Howard IP Law Group PC

(57) ABSTRACT

An adjustable fixture used in the fabrication of cable assemblies including a base, an adjustable frame, and a cable support arrangement attached to the frame. The cable support arrangement configured to house a cable position template, and a plurality of cable fasteners for attaching a plurality of cables into positions indicated by the cable position template.

10 Claims, 5 Drawing Sheets

CABLE AND CONNECTOR PLACEMENT FIXTURE AND METHOD FOR FABRICATING CABLE ASSEMBLIES

STATEMENT OF GOVERNMENT INTEREST

This invention was made with Government support under Contract N00024-03-C-5115 awarded by the Department of the Navy. The Government has certain rights in this invention.

FIELD OF THE INVENTION

The present invention relates to adjustable fixtures used to fabricate and install cable assemblies prior to the installation of equipment.

BACKGROUND

Outfitting a space with electronic equipment often requires the installation of large cable assemblies comprising, for example, power and control connections frequently routed in complex paths. Once routed and cut to length, these cable assemblies typically must be dressed, which may include bundling selected groups of cables together, arranging cables within cable channels, and/or applying protective coverings or cable lacings. Moreover, each cable may have to be fitted with a specific type of connector (connectorized) for interfacing with the equipment.

Often the equipment serviced by these cable assemblies is not located on site at the time of cable installation. This may be the result of an unintentional delay in the delivery of equipment, or of intentional construction planning. For example, in many space-limited areas, installing cable assemblies in the presence of these often-large pieces of equipment creates challenges, as maneuvering this equipment within the constrained area may prove difficult and time consuming. One example of a particularly problematic environment for cable outfitting includes the construction process of ships or other vessels, wherein space limitations often require densely-arranged electronic cabinets and/or consoles for housing, for example, ship control and other secondary systems (e.g. servers, SONAR/RADAR control systems). However, as accurate cable routing and dressing cannot normally be achieved in the absence of the equipment, current methods for cable outfitting include routing cable using rough estimations, and leaving excess cable so it may be cut to suitable length, dressed and connectorized once the equipment is moved into place.

Alternative systems and methods are desired for providing efficient cable assembly preparation, and improved ease of hardware integration.

SUMMARY

In one embodiment of the present invention, an adjustable cable placement fixture is provided. The fixture comprises a base for supporting an adjustable frame mounted thereon. A cable support portion is mounted to the frame such that adjusting the relative dimensions of the frame adjusts the position of the cable support portion. The cable support portion is configured to provide a point of attachment for at least one cable.

According to another embodiment of the present invention, a method of fabricating a cable assembly is provided. The method includes the steps of positioning a cable placement fixture in an area designated for a future cable interface, providing a cable assembly template arranged on the fixture for indicating a predetermined position of a cable, and fabricating a cable assembly by altering at least one of cable length, cable dressing, or cable connectorization according to the cable assembly template.

DETAILED DESCRIPTION

Figure 1B:
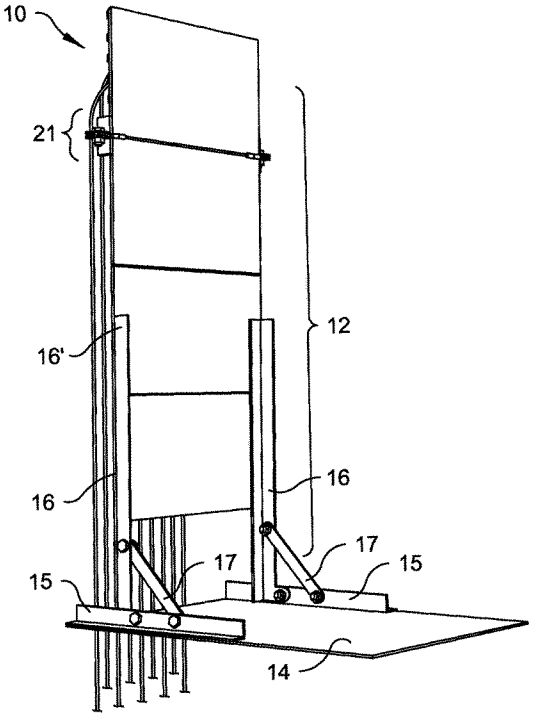
FIG. 1B is a perspective rear view of the embodiment of FIG. 1A.

It is to be understood that the figures and descriptions of the present invention have been simplified to illustrate elements that are relevant for a clear understanding of the present invention, while eliminating, for purposes of clarity, many other elements found in adjustable fixtures, including adjustable/collapsible frames used therewith. However, because such elements are well known in the art, and because they do not facilitate a better understanding of the present invention, a discussion of such elements is not provided herein. The disclosure herein is directed to all such variations and modifications known to those skilled in the art.

In the following detailed description, reference is made to the accompanying drawings that show, by way of illustration, specific embodiments in which the invention may be practiced. It is to be understood that the various embodiments of the invention, although different, are not necessarily mutually exclusive. Furthermore, a particular feature, structure, or characteristic described herein in connection with one embodiment may be implemented within other embodiments without departing from the scope of the invention. In addition, it is to be understood that the location or arrangement of individual elements within each disclosed embodiment may be modified without departing from the scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout several views.

Embodiments of the present invention include adjustable fixtures or jigs which serve as temporary mockups or simulators of electronic equipment designated for future installation within a given space. For a given piece of equipment, it may be known, for example, the type, number and location of its connections (e.g. input/output ports or jacks, etc.). From this information, the adjustable fixture can be put into a position corresponding to the installed position of the equipment, as well as configured to provide a full-size mounting template of the locations and type of all required connections. Using the fixture, technicians may proceed to route, connectorize, and finalize all cable dressings of a cable assembly in the absence of the equipment. Once the cable assembly is completed, the fixture may be removed and, for example, reconfigured for use as a template for another piece of equipment in another location. This process increases efficiency while maximizing available space within the area under construction. Moreover, the actual equipment installation process is also simplified and expedited, as installers must only position the equipment with the workspace, and connect the pre-fabricated cable assembly thereto.

In one embodiment of the present invention, a fixture may be provided comprising an adjustable frame, including a base and at least one cable mounting portion for receiving or attaching cables thereto. In other embodiments, the frame may comprise multiple collapsing, folding or otherwise height-adjustable portions arranged between the cable mounting portion and the base. The cable mounting portion may comprise, for example, a panel or at least one frame member having a plurality of fasteners thereon configured for receiving and securing cables thereto. The fasteners, or their locations with respect to the fixture, may be adjustable, allowing for their reconfiguration to synthesize various types of equipment.

Embodiments of the cable mounting portion may also be configured to hold a connector template for illustrating the proper positioning and/or type of one or more cables/connectors for a given piece of equipment. For example, a schematic diagram of the cable connections required for a piece of equipment may be reproduced onto a card-like template and placed onto or within the fixture. In this way, the proper length, connectors, and cable dressings may be applied to cables such that the cables are fitted to the cable mounting portion as designated by the template. These templates may include any relevant information about a particular connection, including, but not limited to, the location of the connection and the type of connector required. In one embodiment, these templates may be removable or reconfigurable.

Figure 1A:
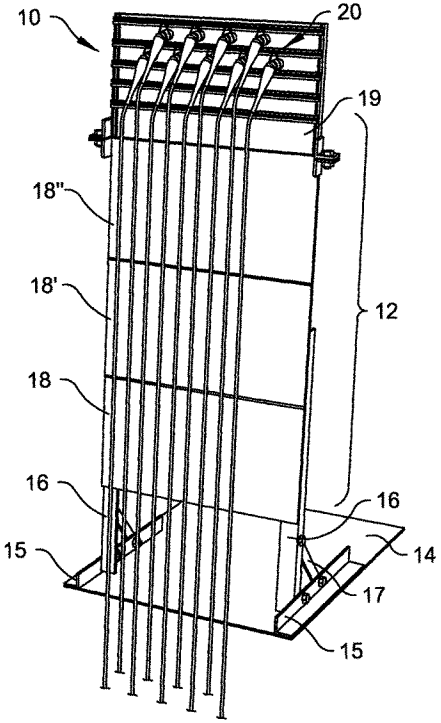
FIG. 1A is a perspective front view of an embodiment of the present invention in an unfolded or opened state.

FIGS. 1A and 1B are perspective front and rear views of an exemplary embodiment of a cable and connector placement fixture 10. Fixture 10 generally comprises a space frame 12 adjustably attached to a base 14. Frame 12 is configured to support a cable support assembly or cable mounting portion 20. In the illustrated embodiment, base 14 comprises a flat plate, however, the base may comprise any suitable arrangement (e.g. legs, rails, etc.) for providing a stable platform for the fixture. The base preferably comprises a light-weight material, which may include metal, metal alloys, polymers or other materials (e.g. composites). In some embodiments, the base may be configured for connecting to the floor, ceiling or wall of a given workspace. For example, many ship-board spaces have standard hole patterns or other mounting features for universal cabinet mounting systems. In these instances, the base may be pre-drilled with this standard hole pattern.

In the illustrated embodiment, frame 12 is attached to base 14 via first and second support members 15 fixedly connected to a top surface of base 14. First and second support members 15 may be formed from, for example, metal angles. Each metal angle comprises two lengths of rectangular metal flat bar oriented at a right angle with respect to one another, thereby defining an L-shaped cross-section. Fasteners (not shown) for connecting support members 15 to base 14 can be disposed in slots or elongated apertures, allowing each support member 15 to be adjustable relative to base 14. In other embodiments, support members 15 may be formed integrally with base 14, or connected thereto via alternate means (e.g. welding).

In the illustrated embodiment, frame 12 comprises a collapsible frame having first and second leg struts 16, first and second lock struts 17, and one or more panels 18. First and second leg struts 16 comprise respective first and second ends. The first end of each leg strut 16 may be pivotally connected to a corresponding support member 15, via, for example, a fastener (e.g. nut and bolt, clevis pin, etc.). The fasteners may be disposed in slot-like apertures formed in each support member 15, allowing for fore/aft adjustment of frame 12 relative to the support members and/or base. Leg struts 16 can be formed by metal angles similar to those forming support members 15 of base 12.

Lock struts 17 comprise respective first and second ends. The first end of each lock strut may be connected (e.g. pivotally) to a portion of a respective support member 15 at a location spaced from the connection of leg struts 16. The second ends of first and second lock struts 17 may be detachably connected with fasteners to a respective leg strut 16. In an unfolded, or open, configuration (FIGS. 1A and 1B), support member 15, leg struts 16 and lock struts 17 form a rigid frame assembly.

In the illustrated embodiment, frame 12 further comprises a plurality of panels, including a bottom panel 18, and intermediate panel, which may be formed as a single panel, or as a combination of upper and lower intermediate panels 18', 18", and a top panel 19. In the exemplary embodiment, top panel 19 forms a portion of cable mounting assembly 20. Each of panels, 18, 18', 18" and 19 comprise first and second sides (i.e. a forward facing side shown in FIG. 1A, and a rearward facing side shown in FIG. 1B). In the exemplary embodiment, bottom panel 18 comprises a bottom side attached to, or formed with, leg struts 16. A bottom portion (e.g. a bottom edge) of intermediate panel 18',18" is pivotally or otherwise moveably connected to a top portion, or edge, of bottom panel 18. A similar pivoting or hinged connection may be provided between intermediate panels 18',18", or these panels may be formed from a single panel without a moveable connection therebetween. Intermediate panels 18',18" are thus foldable with respect to bottom panel 18 such that the front surfaces of intermediate panels 18',18" and bottom panel 18 may abut or face each other in a folded position (see FIGS. 3A and 3B). It should be noted that in the open position illustrated in FIGS. 1A and 1B, an end portion 16' of each leg strut 16 may extend beyond bottom panel 18 and provide support along the rear side of intermediate panels 18',18". In other embodiments, a fastener or clamp may be provide to secure intermediate panels 18',18" to this end portion 16' of leg strut 16.

A top portion of intermediate panels 18',18" may be hingedly or pivotally connected to a bottom portion or a bottom edge of top panel 19. In the illustrated embodiment, a lock or locking means, such as corresponding flanges and a fastener 21 may be provided for locking top panel 19 and intermediate panels 18',18" together along a common plane. It will be understood that these pivoting, hinged, or otherwise moveable connections may be accomplished by any suitable means, such as a continuous (e.g. piano) hinge, hinges places intermediately along the edges of the panels, by any other hinge or pivoting arrangement suitable for connecting the panels to allow rotation and/or movement therebetween. Each of the panels may be constructed of any suitable material, for example, sheet metal, composites, or polymers.

Figure 2B:
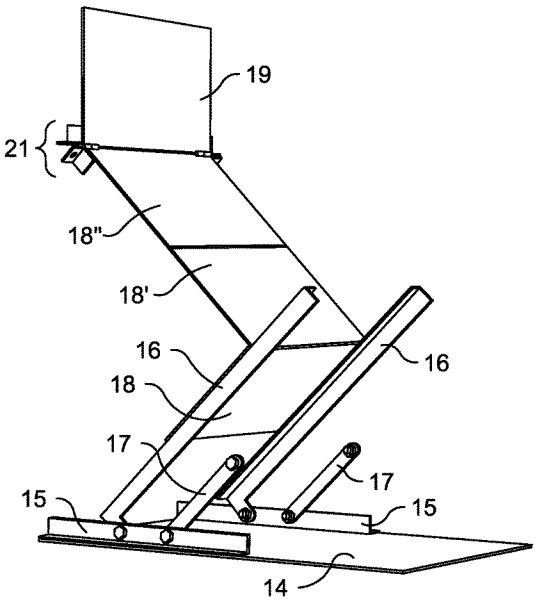
FIG. 2B is a perspective rear view of the embodiment of FIG. 2A.
Figure 2A:
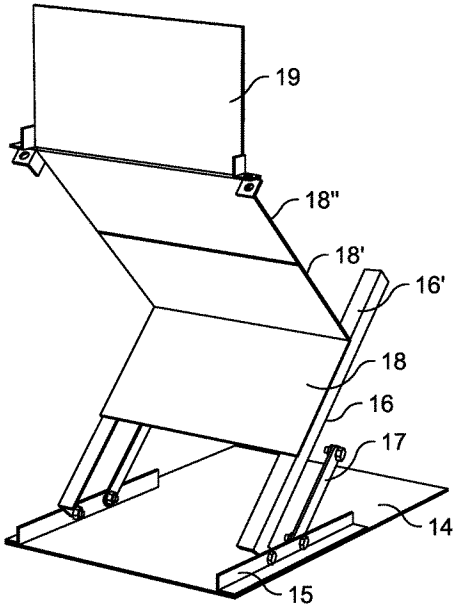
FIG. 2A is a perspective front view the embodiment of FIG. 1A in a partially-unfolded or partially opened state.

Referring generally to FIGS. 2A and 2B, frame 12 may be collapsed from an unfolded or open position, wherein each of the panels are arranged generally along a common plane, by disconnection lock struts 17 from either or both of support members 15 or leg struts 16, allowing for leg struts 16 to be folded or rotated with respect to support members 15 and/or base 14. In other embodiments, one or both of support members 15 and/or leg struts 16 may comprise a slot-like aperture for moveably-receiving fasteners therein. In this way, leg struts 16 may be rotated (e.g. folded) with respect to support members 15 without the need to disconnect lock struts 17 from leg struts 16 or support members 15.

Figure 4:
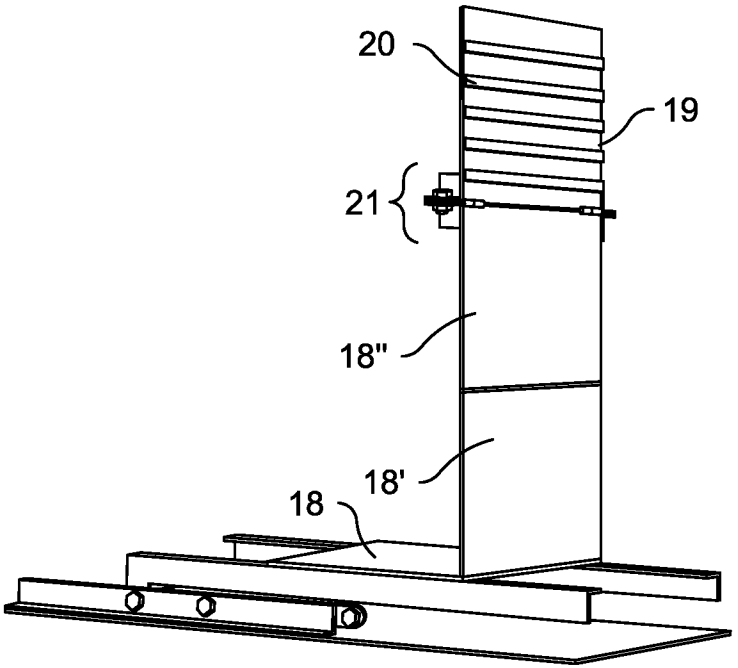
FIG. 4 is a perspective view of the embodiment of FIGS. 1A-3B in an intermediate state.
Figure 3A:
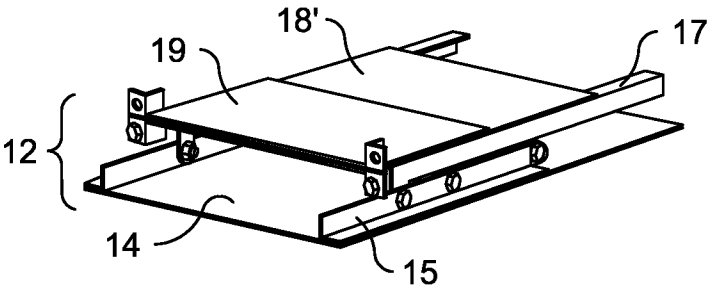
FIG. 3A is a perspective front view of the embodiment of FIG. 1A in a folded or closed state.
Figure 3B:
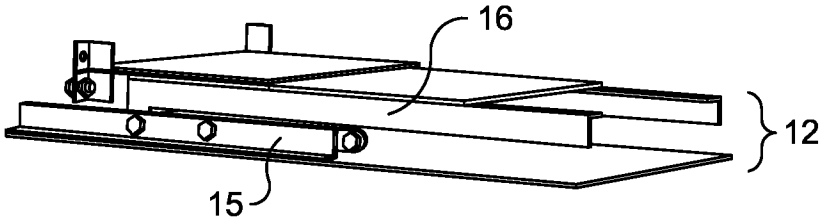
FIG. 3B is a perspective rear view of the embodiment of FIG. 3A.

FIGS. 3A and 3B illustrate fixture 10 in a closed or folded position, wherein fasteners 21, and the hinge arrangement between lower panel 18 and intermediate panels 18',18" are in an unlocked state, and frame 12 is allowed to collapse to achieve a reduced profile for storage and/or transportation. It should be understood that while only folded and unfolded positions are shown, any number of intermediate configurations are possible. For example, FIG. 4 shows one intermediate position wherein fastener assembly 21 remains locked, aligning upper panel 19 and intermediate panels 18',18" together, while the remaining portion of frame 12 has been collapsed. In this configuration, locking of the hinged connection between the lower portion of intermediate panels 18',18" and lower panel 18 provides another functional configuration, wherein cable support assembly 20 remains in a functional position, however, at a lower height than that achieved by the frame in the fully-open position shown in FIGS. 1A and 1B. This arrangement may be useful, for example, for modeling a piece of equipment having interface connections oriented at a lower height.

Figure 5:
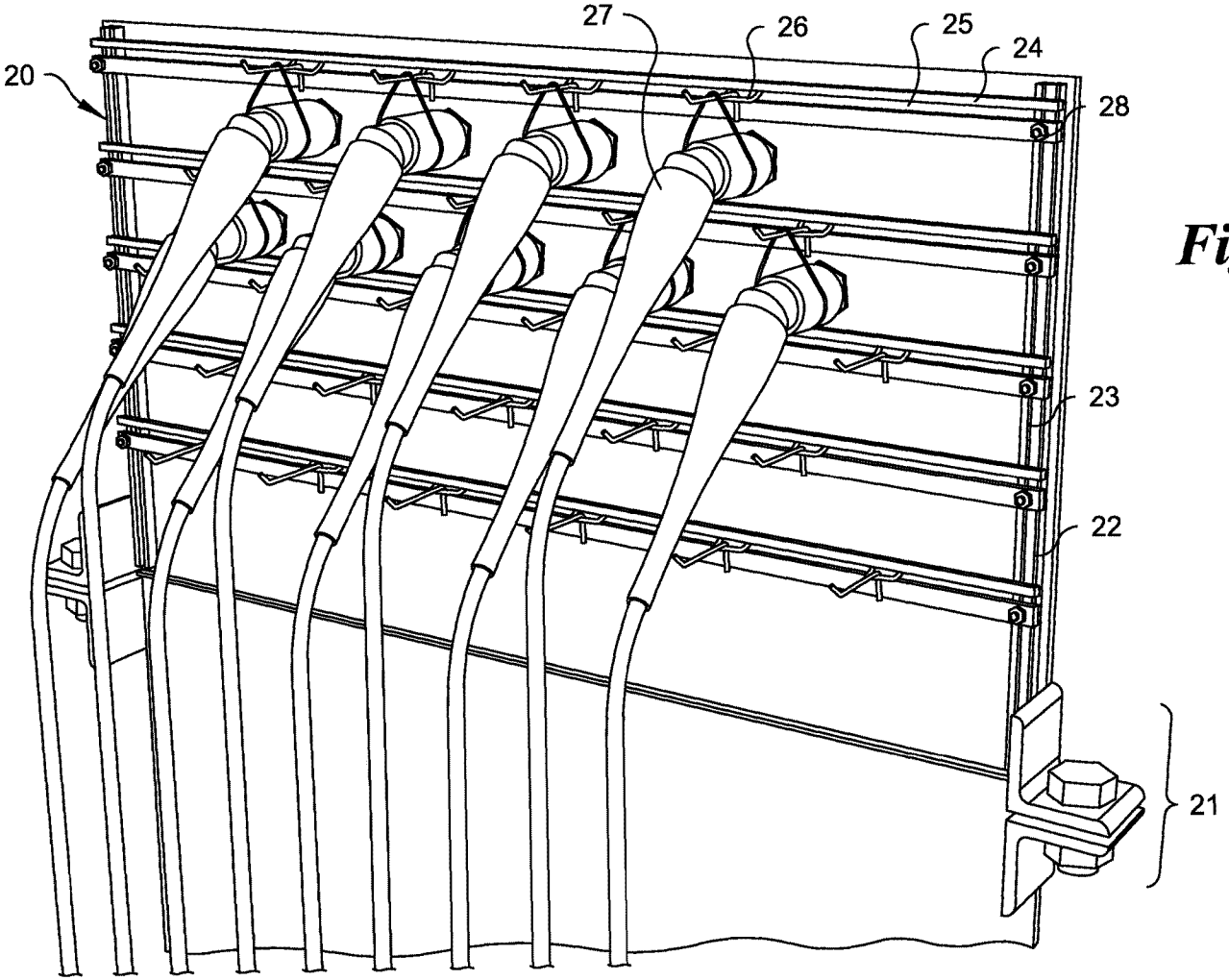
FIG. 5 is a perspective view of a cable holding arrangement according to an embodiment of the present invention.

Referring generally to FIG. 5, cable support assembly 20 is provided for supporting one or more cables thereon. Cable support assembly 20 provides an adjustable, reconfigurable assembly, wherein one assembly 20 may be reconfigured to simulate the interfaces of any number of pieces of equipment of varying types. In the illustrated embodiment, cable support assembly 20 comprises at least two vertical rails 22 for supporting one or more horizontal rails 24. Horizontal rails 24 comprise first and second ends attaching to first and second vertical rails 22 via, for example, fasteners 28. In the exemplary embodiment, horizontal rails 24 are moveable along vertical rails 22 via a channel or groove 23 formed in vertical rails 22. In this way, the placement of, and spacing between, horizontal rails 24 may be altered to vary the cable placement, for example, to match the interface of a given piece of equipment. In the exemplary embodiment, one or more fasteners, such as wire pegs 26, are provided for attaching cables 27 to cable support assembly 20. In one embodiment, a slot or groove 25 is formed in horizontal rails 24, and wire pegs 26 inserted therein. In this way, wire pegs 26 may be moved within slot 25, allowing for assembly 20 to be reconfigured to match any number of unique equipment interfaces.

Figure 6:
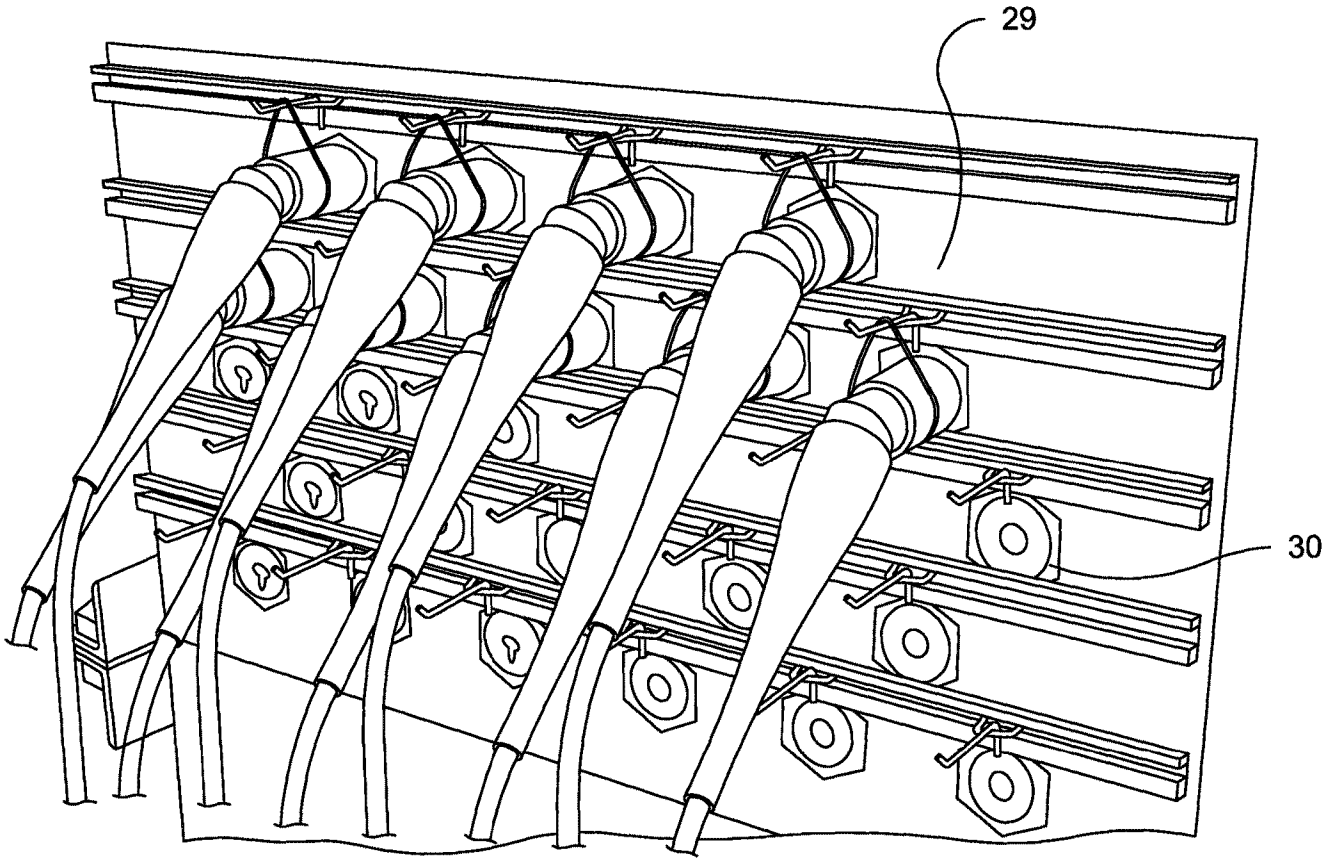
FIG. 6 is a perspective view of a cable holding arrangement including a template according to an embodiment of the present invention.

Referring generally to FIG. 6, in one embodiment, a template 29, for example a template in the form of a printed sheet, may be placed between rails 22,24 and panel 19. Template 29 may include markings 30 illustrating the proper positioning and type of connectors for a given piece of equipment. In this way, when used with fixture 10, template 29 provides an accurate three-dimensional location of each cable connection and cable fastener (e.g. wire peg). This allows for a technician to route, cut and connectorize a cable assembly matching the template. Moreover, because a connectorized cable assembly may be accurately mounted to the fixture, final cable dressing may be performed on the assembly. Thus, once the actual equipment has been delivered, or is ready to be installed, technicians will already have a completed cable assembly in place, and installation of the equipment will only require connecting the cable assembly to the equipment.

While the illustrated embodiment shows a template, such as a paper or card-like template inserted into the fixture, such a template could be printed or otherwise illustrated on panel 19 itself. In this way, a plurality of interchangeable panels 19 could provided, and removable from frame 12. In other embodiments, the sub-frame comprising rails 22,24 may be attached to frame 12, thus, panel 19 may not be required at all, or may be optional to the functionality of the fixture.

While embodiments of the present invention shown and described herein are directed to a pivoting/collapsible frame providing a plurality of hinged panels, it should be understood that any number of other arrangements may be used in place thereof for providing an adjustable, transportable frame for supporting and positioning of a suitable cable support assembly. For example, the intermediate and upper panels may be eliminated from embodiments entirely, and replaced with hinged or pivoting frame members. More specifically, a second pair of leg struts may be hinged to leg struts 16 described above, and the lower/intermediate panels eliminated from frame 12. Moreover, telescoping frame members or poles with the ability to selectively lock and unlock may be used in place of the struts. In this embodiments, the height of cable support assembly 20 may be altered by extending or retracting these telescoping members, rather than by the collapsing or folding of frame 12 as shown.

While the foregoing invention has been described with reference to the above-described embodiment, various additional modifications and changes can be made without departing from the spirit of the invention. Accordingly, all such modifications and changes are considered to be within the scope of the appended claims. Accordingly, the specification and the drawings are to be regarded in an illustrative rather than a restrictive sense. The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations of variations of various embodiments. Combinations of the above embodiments, and other embodiments not specifically described herein, will be apparent to those of skill in the art upon reviewing the above description.

What is claimed is:

1. An adjustable cable placement fixture comprising:

a base;

an adjustable frame comprising:

a first frame member pivotally mounted to the base and moveable between a first storage position and a second expanded position;

a first panel pivotally mounted to the first frame member at a pivot point and moveable between a first storage position and a second expanded position, a portion of the first frame member extending beyond the pivot point to provide support along a rear side of the first panel when the first frame member and the first panel are in respective second expanded positions; and a second panel pivotally mounted to the first panel and moveable between a first storage position and a second expanded position, the second panel sized to receive a template for indicating cable locations; and a cable support portion configured to be mounted over the second panel, the cable support portion comprising:

at least one cable mounting rail; and a plurality of cable fasteners configured to be attached to the at least one cable mounting rail for providing a plurality of cable attachment points, wherein by pivoting one or more of: (i) the first frame member relative to the base, (ii) the first panel relative to the first frame member, and (iii) the second panel relative to the first panel, at least a portion of the adjustable frame is movable with respect to the base such that the cable support portion is movable between:

a first position, wherein the first frame member, the first panel and the second panel are arranged in respective first storage positions;

a second position, wherein the first frame member is arranged in the first storage position and the first panel and the second panel are arranged in respective second expanded positions, such that the cable support portion is positioned at a first height with respect to the base; and a third position, wherein the first frame member, the first panel and the second panel are arranged in respective second expanded positions, such that the cable support portion is arranged at a second height, greater than the first height, with respect to the base.

2. The fixture of claim 1, wherein the at least one cable mounting rail comprises a plurality of cable mounting rails.

3. The fixture of claim 2, wherein the cable support portion further comprises at least one support rail, and wherein the plurality of cable mounting rails are configured to be moveably mounted to the at least one support rail.

4. The fixture of claim 3, wherein the plurality of cable fasteners are moveably mountable along at least a portion of the lengths of the plurality of cable mounting rails such that the plurality of cable fasteners may be selectively moved in at least two dimensions with respect to the second panel for locating the fasteners at positions corresponding to cable locations indicated on a template arranged on the second panel.

5. The fixture of claim 4, wherein the first panel comprises one of a plurality of panels hingedly attached to one another, wherein one of the plurality of panels is further hingedly attached to the first frame member.

6. The fixture of claim 4, wherein the at least one support rail comprises two support rails, each support rail attaching to a respective end of each of the plurality of cable mounting rails.

7. The fixture of claim 6, wherein each of the plurality of cable mounting rails comprises an axial slot formed therein and extending generally between a first end and a second end thereof.

8. The fixture of claim 7, wherein the plurality of cable fasteners comprise wire pegs slidably arranged within the axial slots of the plurality of cable mounting rails.

9. The fixture of claim 1, wherein the second panel comprises a template arranged thereon for indicating cable locations.

10. The fixture of claim 1, wherein the second panel is oriented generally perpendicular to the base when the cable support portion is in each of the second and third positions.

* * * * *